US005243504A

United States Patent [19]

Sejzer

[11] Patent Number: 5,243,504

[45] Date of Patent: Sep. 7, 1993

[54] SALES PROMOTION SYSTEM AND METHOD FOR ATTRACTING CONSUMER ATTENTION TO EACH INDIVIDUAL ARTICLE BEING SOLD

[76] Inventor: Daniel A. Sejzer, 1815 Beverly Pla., Highland Park, Ill. 60035

[21] Appl. No.: 921,216

[22] Filed: Jul. 29, 1992

[51] Int. Cl.[5] ..... F21V 33/00

[52] U.S. Cl. ..... 362/154; 40/544; 362/104; 362/125; 362/191; 362/800

[58] Field of Search ..... 362/125, 154, 104, 190, 362/191, 800; 40/544

[56] References Cited

U.S. PATENT DOCUMENTS

| | | | |
|---|---|---|---|
| 4,209,824 | 6/1980 | Kaufman | 362/98 |
| 4,215,388 | 7/1980 | Reimann | 362/104 |
| 4,231,079 | 10/1980 | Heminover | 362/800 |
| 4,975,809 | 12/1990 | Ku | 362/104 |
| 5,019,438 | 5/1991 | Rapisarda | 362/800 |
| 5,143,439 | 9/1992 | Lewis et al. | 362/191 |

*Primary Examiner*—Carroll B. Dority
*Attorney, Agent, or Firm*—Hill, Steadman & Simpson

[57] ABSTRACT

A sales promotion system and method is provided for attracting consumer attention to each individual article of a plurality of articles being sold and which are typically arranged on a store shelf. Each of the items to be sold has its own blinking light circuit arranged at a display surface of the product. Preferably, the display surface is a front surface or side surface of a box or package containing the item being sold. A light such as an LED driven by the blinking circuit protrudes through an aperture in the display surface. The blinking circuit blinks for a period of time sufficiently long to permit the items to be sold from the store shelf. Thereafter, the purchaser of the item, after opening the package, may remove the blinking circuit and wear the blinking circuit as a promotional button or the like. Preferably all of the plurality of items on the store shelf have their respective display surfaces positioned toward potential consumers so that a group of blinking lights, each blinking at a different time, attracts the consumer. With the invention, the blinking lights are placed inside the box at the display surface when the item is originally being packaged within the box. A thin plastic film may then seal the box over the blinking LEDs prior to shipment. The blinking lights are activated prior to shipment.

21 Claims, 2 Drawing Sheets

SALES PROMOTION SYSTEM AND METHOD FOR ATTRACTING CONSUMER ATTENTION TO EACH INDIVIDUAL ARTICLE BEING SOLD

BACKGROUND OF THE INVENTION

1. Field of the Invention

The present invention relates to a sales promotion method and system for attracting consumer attention to articles being sold or marketed.

2. Description of the Prior Art

It has been known in the prior art for the sale of products in food stores, department stores, or the like to employ a flashing or revolving light connected to a power source for attracting consumer attention to items being sold on a store shelf near the light. Such a promotional light system has been previously mounted on a light pole or at a single location adjacent to shelves carrying a plurality of items being sold.

It has also been known to provide advertising buttons carrying advertising or promotional indicia on the front surface of the button with a pin on the back of the button for pinning the button to a lapel, shirt, or the like of a person. These buttons have been known previously to employ a blinking or flashing light such as a light emitting diode with a small battery and a circuit for blinking, all self-contained on a common circuit board mounted to a back surface of the button, and wherein the mounting pin is also provided on the circuit board. The mounting pin may perform the dual function of a switch such that when the pin is closed, the switch is closed and the blinking begins.

With the prior art store promotional systems, if a portable battery source is used, the battery must typically be of substantial dimensions and of considerable weight in view of the substantial amount of light power required to draw the attention of the consumer to the area containing the products.

In the case of the flashing or blinking promotional buttons worn by persons, such buttons in the prior art have had typical blink rates of 2 or 3 blinks per second, for example, and have a continuous maximum operating lifetime of approximately 150 hours using the relatively small batteries which are self-contained directly on the circuit board behind the front face of the button. The dimensions of such buttons are limited since they are worn by persons on their clothes, and excessive dimensions or weight is considered disadvantageous. Thus, the blink life of the prior art buttons has been relatively short. Such typical flashing buttons have a diameter, for example, of approximately one inch and a thickness of approximately ¼ inch overall for the button including the circuit board on the back of the button.

SUMMARY OF THE INVENTION

It is an object of the present invention to provide a sales promotion system which attracts attention to each individual item of a group of identical items being sold on a store shelf, yet without burdening the store owner with placing of sales promotion devices such as blinking lights adjacent to shelves at which consumer attention is to be drawn.

It is a further object of the invention to provide a sales promotional system which is part of each individual package containing an item being sold, and which offers a premium to the user as a further marketing feature.

According to the present invention, a long life blinking light wafer-like circuit is provided having a continuous operating life such as at least one month with a minimum blink rate of at least once every 30 seconds. Preferably the light is an LED. The wafer-like circuit is mounted at an inside of a display surface of a plurality of identical packages containing goods to be sold such as computer games, software, or other types of products to be placed on store shelves. An aperture is also provided at the display surface for receiving therethrough the light emitting diode of the wafer-like blink circuit. The provision of the aperture in the packaging box display surface and the mounting of the wafer-like blink circuit to the inner face of the display surface occurs at the time that the box containing the goods to be promoted is being closed for shipment.

Since the purchaser of the product receives the blinking light circuit along with the product, the purchaser is further induced to buy the product in view of this premium.

Thereafter, it is preferred that transparent sealing films such as a thin plastic wrap or the like is then wrapped around the box. Typically such boxes may have both cover portions and bottom portions with the cover portion being slipped over the bottom portion. Thereafter, when the sealing wrap is provided, the two parts of the box are thus held together. The sealing wrap then also covers the LED.

Prior to closing and sealing the box, preferably the blinking light is activated such as by closing a pin thereon or otherwise activating a switch, such as by pulling out a pull tab associated with the switch.

The wafer-like circuit can either be mounted directly to the inner surface of the display surface or can be part of a promotional pin which is detachable and later wearable by the user after he opens the package and removes the promotional pin.

Thereafter, the plurality of identical boxes are shipped to the store where they are to be sold.

At the store, they are placed side-by-side on the shelf with the display surface containing the blinking LED facing in a direction toward consumers.

Because each individual identical package has a blinking LED of relatively high intensity during its short on-time, consumers are attracted to each individual package of the group of identical packages. Since the entire group is flashing, at different blink rates, the consumer is attracted to the overall display. Furthermore, since the promotional blinking light is sold as part of the package and is part of the purchase price of the overall package containing the item to be purchased, the consumer also has the benefit of receiving the blinking light as a premium by itself or in the form of a promotional pin which he may later wear.

In a further embodiment of the invention a plurality of blinking lights may be provided on each box. Since the lights are preferably blinking at different times, the user would be attracted to each box as a result of the irregular blinking pattern on each box. Furthermore, if a plurality of blinking lights are provided on each package or box, they can be arranged in a predetermined pattern.

In another embodiment of the invention, one or more lights may be provided on each box whereby a continuous light is emitted from each light source.

There is also the advantage that the proprietor of the store need not concern himself with placement of promotional lights or the like since they are already self-contained in each individual package being sold.

Also, in view of the long life of a blinking system, it is unnecessary for the store owner to be concerned that the blinking system will wear out during the promotional shelf life of the article being sold.

DESCRIPTION OF THE PREFERRED EMBODIMENTS

Figure 1:
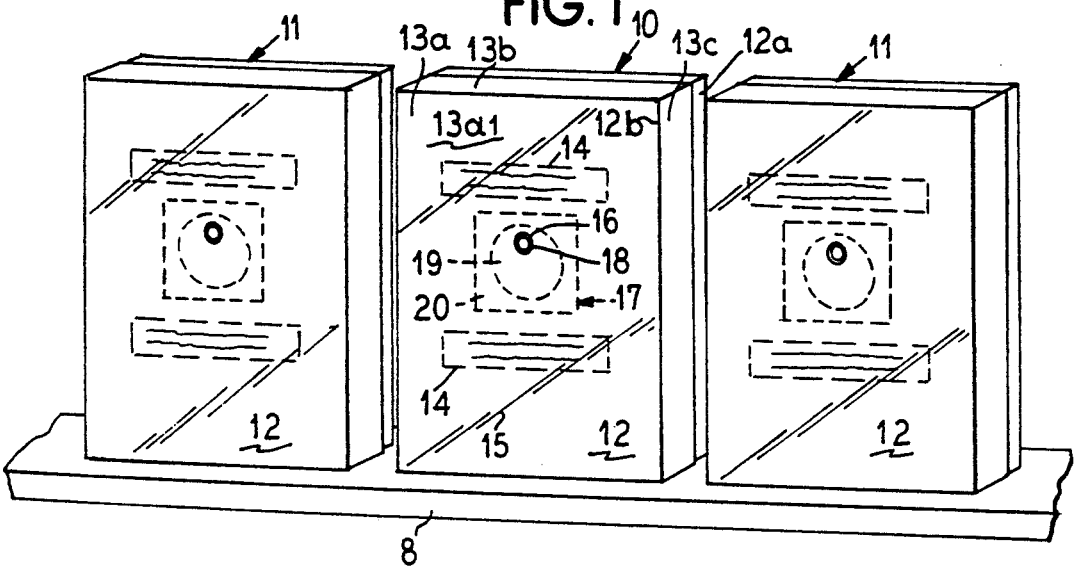
FIG. 1 is a perspective view of the sales promotion system according to the invention.

The sales promotion system and method is generally illustrated at 10 in FIG. 1. Items 11 being promoted formed by packages 12 such as rectangular boxes containing a product being marketed are typically placed side-by-side on a store shelf 8. Normally these packages are all identical. However, it is also possible to have different packages adjacent one another, each containing a blinking circuit. The present invention is particularly useful in connection with the promotion of computer software such as computer games and the like wherein discs and instruction materials are provided within the rectangular box 12 having a top cover portion **12*b* fitted over a rectangular bottom portion 12*a*. The top cover portion 12*b* has a top side 13*b* and a vertical side 13*c*, along with an outwardly facing wall 13*a* having an outer display surface 13*a*1 and an inner surface 13*a*2 (see FIG. 2**).

Figure 2:
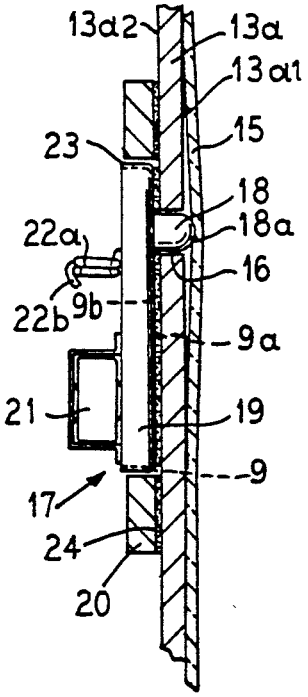
FIG. 2 is a partial side view showing one of the items being promoted and a light blinking circuit installed in a package containing the item in accordance with the system and method of the invention.

According to the invention, all of the packages or boxes 12 on the display shelf selling the same product have mounted in them during manufacture an LED blinking or flashing circuit 19 having an LED 18, such as preferably a red LED, having a conical end portion as shown in FIG. 2. This LED 18 projects through an aperture 16 in the front wall **13*a* of the package or box top cover portion 12*a*. Preferably the tip 18*a* of the LED projects slightly beyond the surface 13*a*1**.

The blinking circuit 19 preferably has an operating lifetime with a built-in battery of at least one month and preferably four to six months, and has a blink rate wherein the LED is on for a relatively short period of time. Preferably the time between blinks is 30 seconds or less and optimally preferably in a range from a half second to six seconds duration between blinks.

The extremely long life of the blink circuit is important since the blink circuit is mounted prior to shipment by the manufacturer, and thus will be blinking from the time of shipment at least until the unit is sold. Of course, the unit or package may remain on the store shelf for a substantial period of time.

A circuit suitable for the above is available from Buztronics, Inc. of Indianapolis, Ind. as part No. TL3122.

The approximate dimensions of this circuit are as follows. The circuit is in a disc shape with a diameter of approximately 1.5 inches (approximately 38 mm), and preferably not greater than 2 inches. The thickness of the wafer-like circuit including a battery 21 and a pin **22*a*, 22*b* shown in FIG. 2** is approximately one-quarter inch, and preferably not greater than one-half inch. Thus, a circuit is provided which has not only long life, which is critical to the present invention, but also is relatively compact and small, a feature which is also important to the present invention, since it must occupy a small space within the package containing the product being promoted, such as software discs, instruction books, etc.

Figure 3:
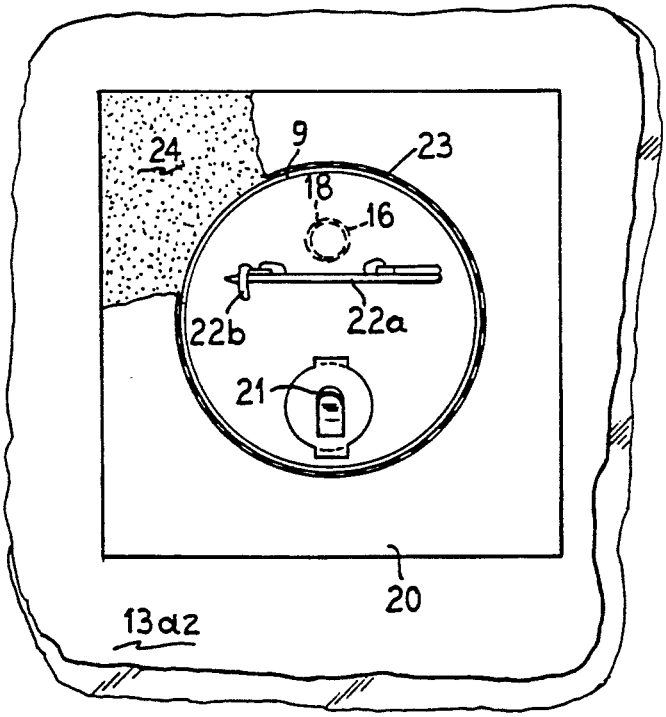
FIG. 3 is a fragmentary rear view of a top cover of the package having the light blinking system in accordance with the system and method of the invention, and wherein the circuit forms a removable button or pin.

An important feature of the invention is that the blinking circuit may also be a button which may be worn by the user after he removes the top cover portion from the bottom portion of the box. Thus, it is advantageous as shown in FIGS. 1, 2, and 3 to provide the pin or button 19 as being removable from a basic mounting piece 20. This can be accomplished by a perforation 23, for example. Preferably piece 20 is rectangular.

As shown in FIG. 2, the wafer-like disc circuit 19 has a horizontally positioned pin **22*a* retained under a pin latch 22*b*. When the pin is received within the latch 22*b*, an electrical circuit is closed and the LED 18** blinks.

Although the use of LEDs is preferred, the light source may also, within the scope of this invention, be formed as an LCD, fiber optic, incandescent, or even fluorescent. What is important, of course, is that the light source be capable of being driven by a chip having a long battery life.

A method of the invention will now be described.

Initially, the blinking circuit 19 is adapted to be formed as a pin or button by providing a button surface 9 as shown in FIGS. 2 and 3 which, for example, may be cup-shaped and which receives the circuit 19 therein at an inner surface thereof. Sales promotion indicia may be then put on the outer surface 9*a* of the pin opposite the inner surface 9*b* where the wafer-like circuit 19 is attached to the button surface 9 such as by gluing.

The box or package 12 containing the product being promoted has on its front cover 12*b*, and preferably at the display surface 13*a*1 various advertising or promotional indicia 14 indicating what is being sold within the container. This indicia may be writing, drawing figures, or the like. The positioning of the aperture or hole 18 may be chosen so as to coincide with portions of the drawing or illustration on the front cover of the display surface 13*a*1. Thus, the blinking LED 18 may be employed to draw attention to a particular portion of the indicia on the front display surface.

A circuit board 19 for blinking is in the first preferred embodiment mounted at the back side 9*b* of the button or pin 9. This button 9 may be connected by perforations as shown at 23 in FIG. 3 to the outer mounting surface 20. The outer mounting surface 20 is glued or adhered with an adhesive layer 24 to the back surface 13*a*2 of the display surface wall 13.

Thereafter, and assuming that the product being promoted has already been packed within the container or box 12, then the blinking LED circuit is actuated by closing the pin 22*a* with the latch 22*b* so that contact is established. Thereafter, the cover or top portion 12*b* is placed over the bottom portion 12*a* of the box. Finally, a shrink wrap or other type of clear plastic film 15 is wrapped around the entire container or box so as to seal the same in its closed configuration.

The containers are all then shipped to the appropriate store or stores for distribution and/or sale.

When they are received at the final destination for promotion and sale, they are placed on store shelves 8 side-by-side with the display surface 13*a* facing outwardly and preferably with the identical packages side-by-side as shown in FIG. 1.

Because of the long life blinking circuit provided (at least one month and preferably 4–6 months), even if the product does not sell within the first few weeks, the LEDs continue to blink.

When the purchaser opens the box, he then has the option of removing the button 19 at the perforation 23 and wearing the button. Thus, the product promotion may continue even after the purchaser has purchased the product, since when he wears the button, the promotional indicia on the outside surface of the button can be seen by others.

Figure 4:
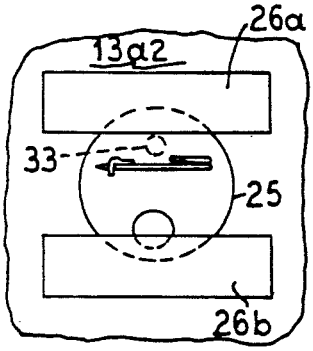
FIG. 4 shows an alternate embodiment of FIG. 3 for holding the removable pin or button to a rear surface opposite a display surface of the package.

An alternate embodiment of the invention is shown in FIG. 4 wherein rather than the mounting surface 20, two tape strips 26*a*, 26*b* overlap the button and retain it to the inner mounting surface 13*a*2.

Figure 5:
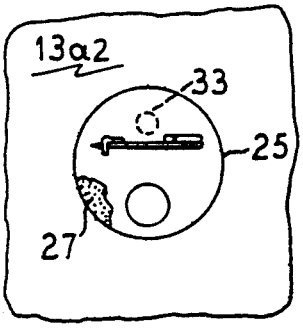
FIG. 5 shows a further alternate embodiment of FIG. 3 for retaining the pin or button on the rear surface opposite the display surface.

In FIG. 5 a further embodiment is shown wherein a peeloff adhesive layer 27 may be provided to hold the button directly on the surface 13*a*2. In this embodiment as in the case of FIG. 4, the LED proceeds through an aperture 33.

Figure 6:
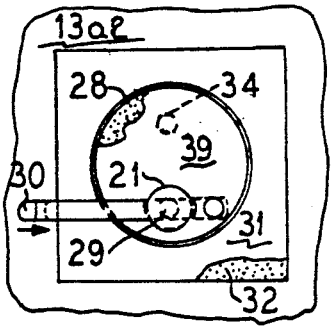
FIG. 6 is an alternate embodiment of the invention wherein the blinking circuit is adhered to a back surface opposite the display surface of the package and has a removable tab for actuating the circuit, rather than the pin shown in FIGS. 3–5.

In the alternate embodiment of FIG. 6, only a circuit wafer 39 is provided and no button is attached to the wafer 39. Rather, the circuit wafer 39 is attached by adhesive 28 to a mounting film or plate 31 which in turn is adhered with adhesive 32 to the inner mounting surface 13*a*2. A pull tab 30 is placed between the battery 21 and overlying battery contacts 29 so that the circuit is activated by pulling out the insulating tab.

Figure 6A:
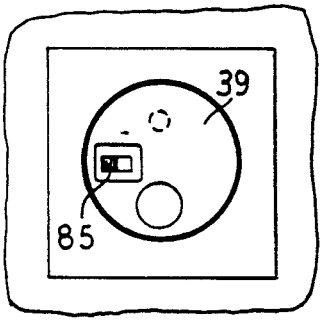
FIG. 6A is an alternate embodiment of FIG. 6 wherein an on-off switch is employed in lieu of the pull tab shown in FIG. 6.

FIG. 6A is an alternate embodiment wherein an on-off slide switch 85 is provided instead of the pull tab to activate the circuit wafer 39.

Figure 7:
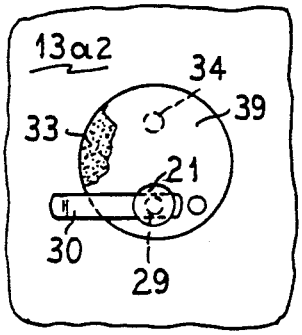
FIG. 7 is an alternate embodiment of FIG. 6 showing an alternate way of attaching the blinking circuit to the rear surface opposite the display surface.

FIG. 7 is an alternate embodiment wherein the circuit wafer 39 is attached via adhesive 33 to the mounting surface 13*a*2.

Figure 8:
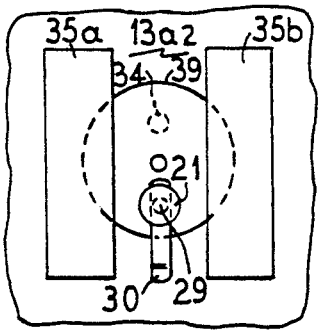
FIG. 8 is an alternate embodiment of FIG. 6 showing a further alternate embodiment for attaching the blinking circuit to the rear surface.

In the alternate embodiment of FIG. 8 tape strips 35*a*, 35*b* retain the circuit wafer 39 on the mounting surface 13*a*2.

Figure 9:
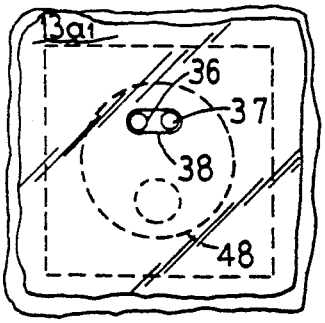
FIG. 9 is an alternate embodiment wherein a light sensor is provided alongside the blinking LED.

In the alternate embodiment of FIG. 9 (which is a fragmentary front view of the display surface 13*a*1), an elongated slot 38 accommodates both the LED 36 and a light sensor 37. The light sensor turns off the blinking LED wafer circuit 48 in periods of darkness such as when the store is closed in the evening so as to conserve battery energy.

Figure 10:
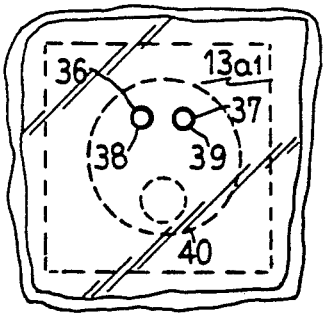
FIG. 10 is an alternate embodiment of FIG. 9 wherein a light sensor is employed.

In FIG. 10 an alternate embodiment is shown wherein the LED 36 is in its own separate aperture 38, whereas the light sensor 37 is in a separate aperture 39 alongside the aperture 38. The sensor and the LED are mounted on a circuit wafer 40.

Figure 11:
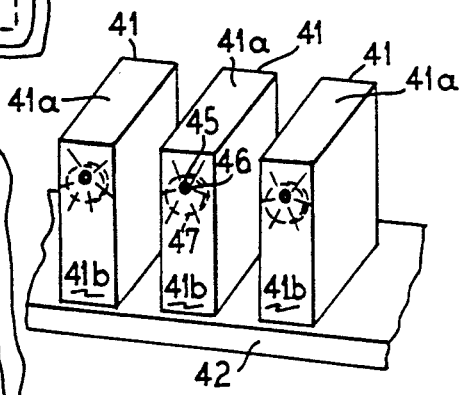
FIG. 11 is an alternate embodiment of FIG. 1 wherein the blinking circuit is provided at a side display surface where identical packages are placed sideways on a shelf or rack within the store.

With the present invention, the display surface may be any of the outwardly facing surfaces of the box or container. For example, in a box 41 which opens at the top 41*a* as shown in FIG. 11, and wherein such containers or boxes are placed with their narrow sides 41*b* facing outwardly, such narrow sides 41*b* may have the LED 45 in an aperture 46 provided thereat. Thus, each of the containers 41 shown in FIG. 11 would have an LED 45 blinking with the containers being side-by-side with their narrow sides forming the respective display surfaces. The packages are provided on a shelf 42.

Figure 12:
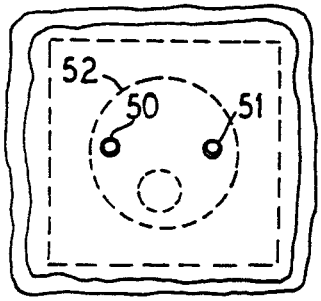
FIG. 12 is an alternate embodiment of the invention wherein each wafer-like blinking circuit in each box or package has at least two blinking lights spaced from one another.
Figure 13:
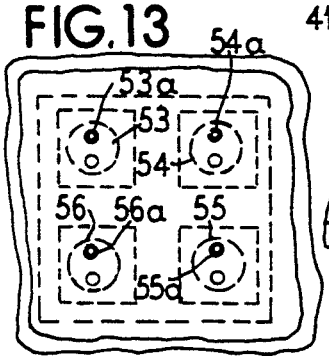
FIG. 13 is an alternate embodiment of the invention wherein each box or package may contain two or more wafer-like blinking circuits which are spaced from one another at a display surface of the package.

In an alternate embodiment of the invention as shown in FIG. 12, two or more blinking LEDs may be provided in spaced apart fashion on a common blinker circuit wafer 52 on each package. By blinking in non-synchronous fashion, consumer attention is drawn to each of the packages. Alternatively, as shown in FIG. 13, a plurality of blinker circuits 53, 54, 55, 56 may be provided in each package so that at the display surface, the blinking LEDs 53*a*, 54*a*, 55*a*, and 56*a* may be arranged in a geometric pattern across a face of the display surface of the package. For example, a marquis effect could be thereby provided.

Alternatively to a blinking light on each package, a continuously illuminated light may be provided on each package so that when a plurality of such packages are placed on a store shelf such as shown at 42, all of the lights are illuminated on each of the packages in the group.

Although various minor changes and modifications might be proposed by those skilled in the art, it will be understood that I wish to include within the claims of the patent warranted hereon all such changes and modifications as reasonably come within my contribution to the art.

I claim as my invention:

1. A sales promotion system, comprising:

a plurality of items to be sold and arranged on a store shelf;

each of the items to be sold having its own blinking light circuit with a blinking light arranged at a display surface for the item;

the display surface of each of the products being positioned on the shelf to face toward potential consumers;

all of the plurality of items being substantially identical and being packaged in substantially identical boxes; and the blinking light circuit comprising a circuit wafer connected to a display button, and means being provided for permitting the display button to be removed from the item being promoted to the consumer, and said button having pin means for enabling the consumer to wear the button on his clothing.

2. A sales promotion system, comprising:

a plurality of items to be sold and arranged on a store shelf;

each of the items to be sold having its own blinking light circuit with a blinking light arranged at a display surface for the item;

the display surface of each of the products being positioned on the shelf to face toward potential consumers; and the blinking light circuit having an LED, the circuit being mounted at an inner surface of the display surface of a package containing a product to be promoted, and an aperture provided in the display surface of the package with the circuit being positioned so that the LED protrudes through the aperture allowing it to be visible by the consumers.

3. A system according to claim 2 wherein a plastic film surrounds the package and overlaps the blinking LED.

4. A system according to claim 2 wherein the LED circuit has means for permitting the LED to blink continuously without battery replacement for at least one month.

5. A system according to claim 4 wherein a blink rate of the LED is at least once every 30 seconds.

6. A system according to claim 5 wherein the blink rate is between 3 and 6 seconds.

7. A system according to claim 2 wherein the blinking light circuit blinks the LED for at least four months with a battery built into the circuit and without replacement of the battery.

8. A system according to claim 1 wherein the blinking light circuit has outer dimensions no greater than 2 inches and an overall thickness including the battery of not greater than ½ inch.

9. A system according to claim 1 wherein the blinking light circuit has at least two blinking lights thereon arranged at the display surface for the item in spaced apart fashion.

10. A system according to claim 1 wherein at least two blinking light circuits are provided each having at least one blinking light arranged at said display surface, said two blinking light circuits being mounted in spaced apart fashion.

11. A method for promoting a group of products, comprising the steps of:

providing a blinking circuit having a light and a self-contained battery within the blinking circuit, and the blinking circuit having capability to blink for at least one month continuously without replacement of the battery;

providing a plurality of products to be promoted and a respective box for containing each of the products;

prior to packaging the products in the respective boxes, placing in each of the boxes at an inner surface thereof the blinking circuit and attaching it there such that the light on the circuit protrudes through an aperture in a display surface of the box;

enabling the circuits so that the respective lights begin to blink;

after the products have been placed in the respective boxes, closing the boxes;

shipping the boxes to a sales destination; and placing the boxes side-by-side on a store shelf with all of the lights blinking and with the respective display surfaces positioned to face potential purchasers.

12. A method according to claim 11 including the step of placing a clear sealing film around the boxes and over the blinking lights after closing the boxes and prior to shipment.

13. A method according to claim 11 including the step of providing the blinking circuit as a circuit wafer adhered to a back of a promotional button and fixing the promotional button to the inner surface of the box in a removable manner; and a consumer, after purchasing the box, removing the button and wearing the same when it is blinking.

14. A method according to claim 11 wherein all of the boxes are substantially identical for selling a same product contained in each of the boxes.

15. A method according to claim 11 wherein all of the lights of the boxes are blinking at different times.

16. A sales promotion system, comprising:

a plurality of boxes containing items to be sold and arranged on a store shelf as a group and in close proximity to one another;

each of the boxes having its own blinking light circuit with a blinking light arranged at a display surface on the box, with the display surfaces of the boxes all facing towards potential consumers;

the blinking light circuit each having means for permitting blinking of the light without battery replacement for at least one month continuously; and the blinking light circuits each being mounted at an inner surface of said display surfaces within the boxes, the blinking light being positioned for viewing by the potential consumers through an aperture in said display surfaces.

17. A method for promoting a group formed of a plurality of boxes having the same products therein, comprising the steps of:

providing a blinking circuit with a light in each box, said blinking circuit being attached so that the light of the blinking circuit is visible through an aperture in a display surface of the box which is to be faced towards consumers on a store shelf;

activating the blinking lights and placing the products into the boxes;

closing the boxes;

shipping all of the boxes to the store; and placing all of the boxes on the store shelf side-by-side in a group so that all of the blinking lights are facing towards potential consumers.

18. A sales promotion system, comprising:

a plurality of items to be sold and arranged on a store shelf;

each of the items to be sold being contained in a respective box and each of the boxes having its own light circuit means for repeatedly blinking a light arranged at a display surface of the box containing the item being sold; and the display surface of each of the boxes being positioned on the shelf to face toward potential consumers.

19. A method for promoting a group of substantially similar products comprising of a plurality of boxes having the products therein, comprising the steps of:

providing a blinking circuit with a light on each box, said blinking circuit being attached to the box so that the light of the blinking circuit is visible at a display surface of the box which is to be faced towards consumers on a storage shelf;

first activating the blinking lights and thereafter wrapping the boxes for shipment to a store for display on said store shelf;

shipping the boxes to the store; and at the store unwrapping the boxes with the blinking lights still blinking and placing the boxes on the store shelf side-by-side in a group so that the blinking lights are facing towards potential consumers.

20. A method for promoting a group of substantially similar products comprising a plurality of boxes having the products therein, comprising the steps of:

providing a blinking circuit with a light on each box, said blinking circuit being attached to the box so that the light of a blinking circuit is visible at a display circuit of the box which is to be faced towards consumers on the store shelf;

providing the blinking light circuit so that the light will blink continuously for at least one month without battery replacement;

first activating the blinking lights and thereafter wrapping the boxes for shipment to a store for display on said store shelf;

shipping the boxes to the store; and at the store unwrapping the boxes with the blinking lights still blinking and placing the boxes on the store shelf side-by-side in a group so that the blinking lights are facing towards potential consumers.

21. A method according to claim 20 wherein after activation, the blinking lights remain blinking for at least a month.

* * * * *